US011161634B2

(12) United States Patent
Ribi

(10) Patent No.: US 11,161,634 B2
(45) Date of Patent: Nov. 2, 2021

(54) PLANT FOR APPLYING STRAPS TO A GROUP OF CONTAINERS SUCH AS BOTTLES OR THE LIKE

(71) Applicant: RIBI LIMITED, London (GB)

(72) Inventor: Leon Ribi, Troistorrents (CH)

( * ) Notice: Subject to any disclaimer, the term of this patent is extended or adjusted under 35 U.S.C. 154(b) by 245 days.

(21) Appl. No.: 16/333,708

(22) PCT Filed: Oct. 7, 2016

(86) PCT No.: PCT/IB2016/056013
§ 371 (c)(1),
(2) Date: Mar. 15, 2019

(87) PCT Pub. No.: WO2018/065810
PCT Pub. Date: Apr. 12, 2018

(65) Prior Publication Data

US 2019/0217979 A1 Jul. 18, 2019

(51) Int. Cl.

| | |
|---|---|
| ***B65B 17/02*** | (2006.01) |
| ***B65B 13/02*** | (2006.01) |
| ***B65B 13/04*** | (2006.01) |
| ***B65B 21/06*** | (2006.01) |
| ***B65B 27/04*** | (2006.01) |
| ***B65B 61/14*** | (2006.01) |
| ***B65B 13/18*** | (2006.01) |
| ***B65B 35/36*** | (2006.01) |

(52) U.S. Cl.
CPC ..... *B65B 13/02* (2013.01); *B65B 13/185* (2013.01); *B65B 17/02* (2013.01); *B65B 27/04* (2013.01); *B65B 35/36* (2013.01); *B65B 61/14* (2013.01)

(58) Field of Classification Search
CPC ..... B65B 17/02; B65B 13/02; B65B 13/04; B65B 21/06; B65B 27/04; B65G 47/841; B65G 2201/0244; B65G 47/084; B65G 47/088
See application file for complete search history.

(56) References Cited

U.S. PATENT DOCUMENTS

| | | | |
|---|---|---|---|
| 3,073,086 A | 1/1963 | Ronald | |
| 5,667,055 A | 9/1997 | Gambetti | |
| 2004/0154902 A1 | 8/2004 | Schoeneck et al. | |
| 2012/0210674 A1* | 8/2012 | Perl | B65B 13/22 53/396 |

(Continued)

FOREIGN PATENT DOCUMENTS

| | | |
|---|---|---|
| DE | 102011108835 A1 | 1/2013 |
| DE | 102013209151 A1 | 11/2014 |

(Continued)

*Primary Examiner* — Praachi M Pathak
(74) *Attorney, Agent, or Firm* — Themis Law

(57) ABSTRACT

An operating unit adapted to perform a rapid packing of containers such as bottles produces a safe, simple and transportable pack obtained with three straps, of which a first one is applied on the lower half of the body of the bottles, a second one is applied at the neck of the bottles, both the first and the second straps being arranged on planes perpendicular to the vertical axes of the bottles, and a third one, applied loosely and perpendicularly to the other two straps, lies on a vertical plane passing by the center of gravity of the pack, along a plane disposed between two adjacent rows of bottles in contact with each other.

27 Claims, 11 Drawing Sheets

(56) References Cited

U.S. PATENT DOCUMENTS

| | | | | |
|---|---|---|---|---|
| 2020/0216206 | A1* | 7/2020 | Ribi | B65B 61/14 |
| 2020/0270008 | A1* | 8/2020 | Oppici | B65B 35/24 |

FOREIGN PATENT DOCUMENTS

| | | | |
|---|---|---|---|
| GB | 1487896 | A | 10/1977 |
| WO | 2013018047 | A2 | 2/2013 |
| WO | 2014118261 | A1 | 8/2014 |

* cited by examiner

PLANT FOR APPLYING STRAPS TO A GROUP OF CONTAINERS SUCH AS BOTTLES OR THE LIKE

Plant for packing PVC bottles or other similar containers in packs by applying band-like bindings called also as straps.

Currently in prior art beverage bottles 1 made of PET are packed into packs of four or six elements mainly by means of sheets made of heat-shrink plastic polymers.

The present invention on the contrary relates to a new type of rapid packaging and therefore to a new type of safe and economic plant by using band-like bindings, that is straps 24 that can be applied with suitable and specific arrangements by conventional strapping machines.

Said machines have already been used for a long time for packaging packs, boxes or various containers but they have not been industrially used yet for assembling PET bottles. Some isolated experimental attempts are only known however resulting in poor convincing results as regards efficacy and with poor implementation results.

The invention aims at providing a strapping plant particularly for bottles but also for other similar containers that can overcome drawbacks of current attempts and that can make the strapping technology usable also for packs of containers.

Particularly the invention provides to make a particular type of pack where an ordered group of bottles comprise a predetermined number of bottles with a given relative position with respect to each other and held together by at least one, preferably two straps oriented perpendicularly to the axes of the bottles.

According to one embodiment said straps are provided also at a given distance one from each other. A third loose strap is provided arranged in a plane parallel to the axes of the bottles and surrounding at least one or both the horizontal straps thus forming an handle.

The invention achieves the above aims by the combination of characteristics of claim 1.

Therefore the invention provides a plant for applying straps to a group of containers such as bottles or the like, which group comprises a predetermined number of containers arranged according to a predetermined order and a predetermined relative position with respect to each other and which plant provides, in sequence along a feeding path of the containers or groups:

- a grouping or assembling conveyor for a set of containers arranged in upright position or resting on a conveying surface with their rest side on a conveying surface, which grouping conveyor generates groups of containers having a predetermined number of containers with a predetermined relative position, the feeding direction along said conveyor being substantially in the horizontal plane;
- a conveyor lifting the container groups, in sequence with each other, along a vertical lift path for feeding and unloading a group of each group of containers to a first strapping station intended to apply at least one, preferably two straps, spaced from each other in the axial direction of the containers, that is in the direction perpendicular to the rest side thereof, to the container group;
- a horizontal transfer device for the groups of containers provided with the strap or straps applied in the first strapping station and that transfers each group to a second strapping station;
- said second strapping station being configured for applying a loose strap developed substantially in a plane vertical and/or perpendicular to the rest side of the containers and/or parallel to the axis of the containers and which loose strap surrounds the strap or straps applied in the first strapping station.

According to a characteristic, the lifting conveyor is configured for moving each group of containers of the sequence from an initial container infeed level in the lifting conveyor, to an intermediate lift level where there is provided the first strapping station and from this second level to a third upper level unloading the group of containers provided with the strap or straps applied in the first strapping station by lift steps corresponding to the relative distance between two subsequent levels.

Preferably the distance between said levels corresponds to the size of the containers in the lifting direction, the containers of the lower level being pushed upwardly by means of lifting pusher members and the containers of the second level being moved to the subsequent third level by the containers of the level below that rest by their upper sides on the lower sides of the containers of the group at the level above.

According to a characteristic the containers of the groups of containers at the upper levels are held in the lifted position by[E1] means of a holding support that is operable alternatively in an operating position interfering with the group of containers wherein such interference allows the containers at said level to be held and in an idle position not interfering with said containers, wherein the lift path from the current level to the upper level is cleared.

Preferably said removable supports are composed of support surfaces provided at said upper levels which are formed of several parts completing with each other and movable together in a direction near to each other and arranged under the rest sides of the containers of the corresponding group and alternatively in a direction moving away from each other and moving away from the containers of the corresponding group.

One embodiment provides such parts of the support surface to be made as a fork.

One alternative embodiment provides the holding supports to be composed of grippers provided with at least two opposite jaws shaped in a manner corresponding to the profile or shape of the containers on the sides of the group facing said jaws.

According to another variant embodiment, the plant of the present invention provides, instead of the elevator lifting conveyor described above, a transfer device of the pick and place type, such as a robotic arm that by means of a grasping gripper picks the containers of each group fed to the level of the first strapping station, holds in place said containers during the strapping operation and transfers them to the second strapping station.

According to a variant, the pick and place transfer device is made or configured such that it picks, by a grasping gripper, the groups of containers at the lower level, when exiting from the conveyor grouping/assembling the groups of containers.

Still according to a further characteristic that is applied when the containers are arranged on several rows and lines and each group has several rows of four containers, downstream the first strapping station the plant provides a station applying glue between at least two containers of the group provided in an intermediate position of the arrangement of containers of said groups with the aim of preventing or restraining these two containers from accomplishing a mutual counter-rotation movement and preventing the containers of the strapped group from taking a quincunx position.

According to a variant embodiment the plant according to one or more of the characteristics described above provides in the path of the containers of the conveyor grouping or assembling the bottle groups or upstream thereof a grouping and strapping station for at least two containers that are intended to take a central or intermediate position inside the arrangement of containers of a group of containers corresponding to the position they take in the group of containers provided with straps.

The mutual tightening of the at least two containers in the central and intermediate position is provided with such a tightening force that, the friction between the contact areas of said two or more containers is increased to such an extent to at least restrain a mutual counter-rotation movement of the two or more containers or possibly also to prevent them from accomplishing such relative counter-rotation movement preventing the containers of the group from taking a quincunx position.

Such solution is applied particularly in groups of containers arranged on rows and lines parallel to each other and having at least six containers. In this case the two containers of the central line are connected to each other by the quincunx-preventing strap as described above.

The invention relates also to a pack composed of a group of containers, comprising a predetermined number of containers in contact with each other and arranged on several rows and lines such that between two adjacent containers there is only one tangent line, that is the central axes of the shell surfaces of the containers are spaced from each other to an extent corresponding to the diameter or to a greater diameter thereof, the containers of said group being held together by at least one strap that surrounds on the outside the group and that extends along a plane substantially parallel to a rest side of the containers and/or perpendicular to the central axis of the shell surfaces of said containers and at least two containers of said group provided in a central position of said group being bound together by a further band-like element closed on itself and exerting an action tightening said two containers one against the other one such to substantially restrain or prevent said two containers from accomplishing a relative counter-rotation.

The dependent claims are advantageous improvements of different embodiments of the plant according to the present invention.

Further improvements are the subject matter of the dependent claims.

The characteristics of the invention will be more clear from the following description of some embodiments shown in the annexed drawings wherein.

DETAILED DESCRIPTION AND OPERATION OF THE PLANT

Figure 1:
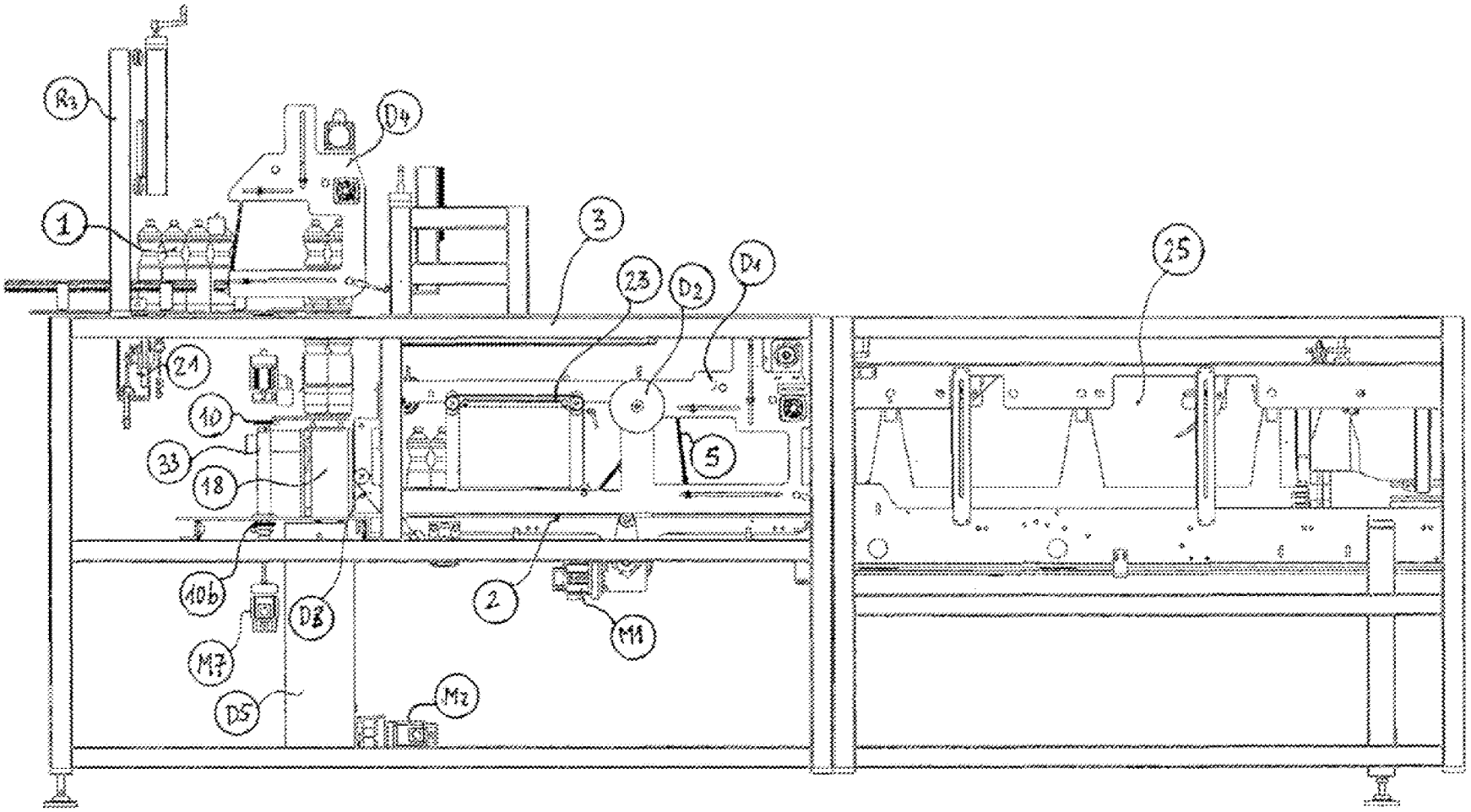
FIG. 1 is a side overview of the plant.
Figure 2:
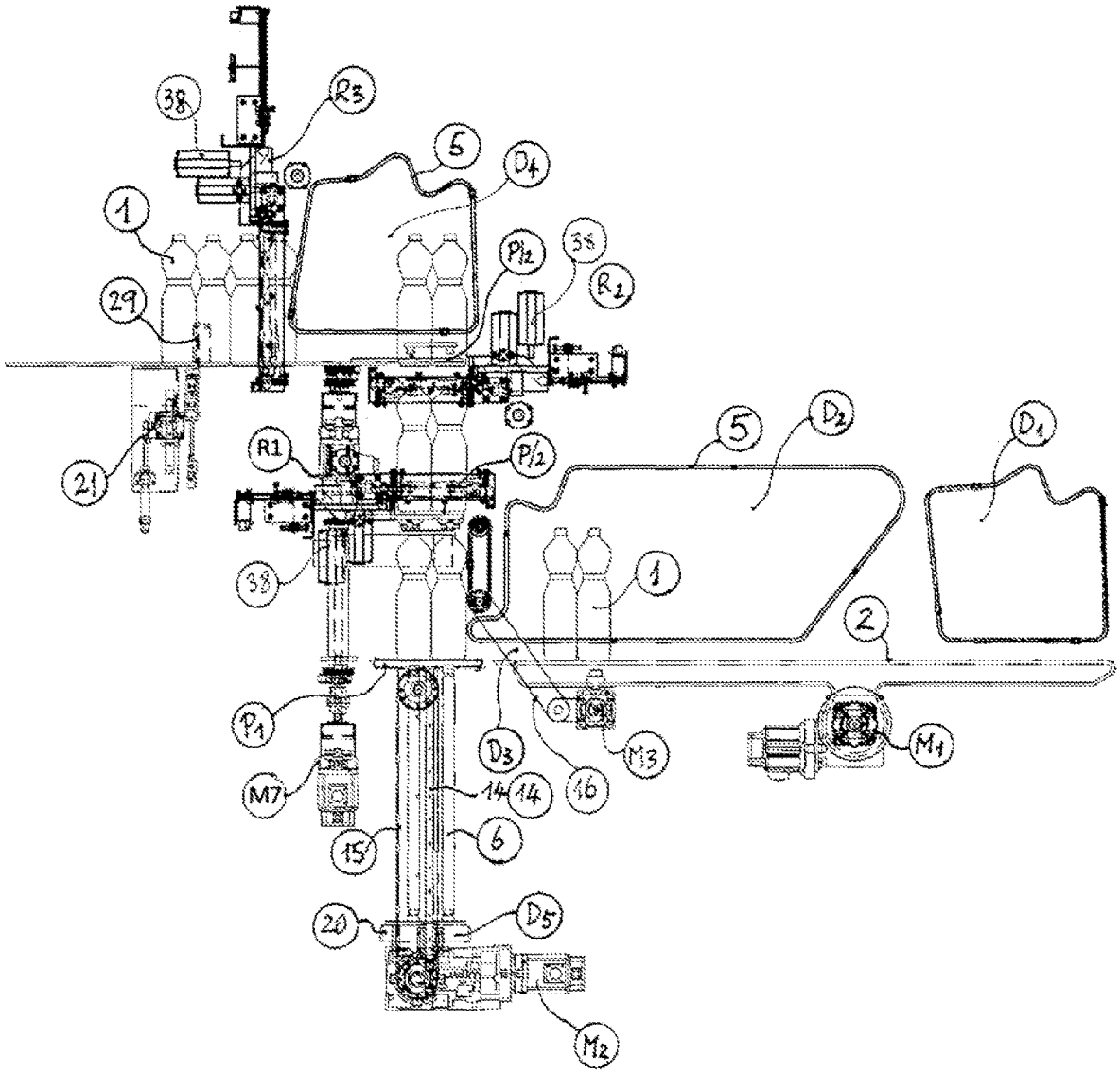
FIG. 2 is a side schematic view (with no details of the movement devices D1, D2, D3, D4).
Figure 3:
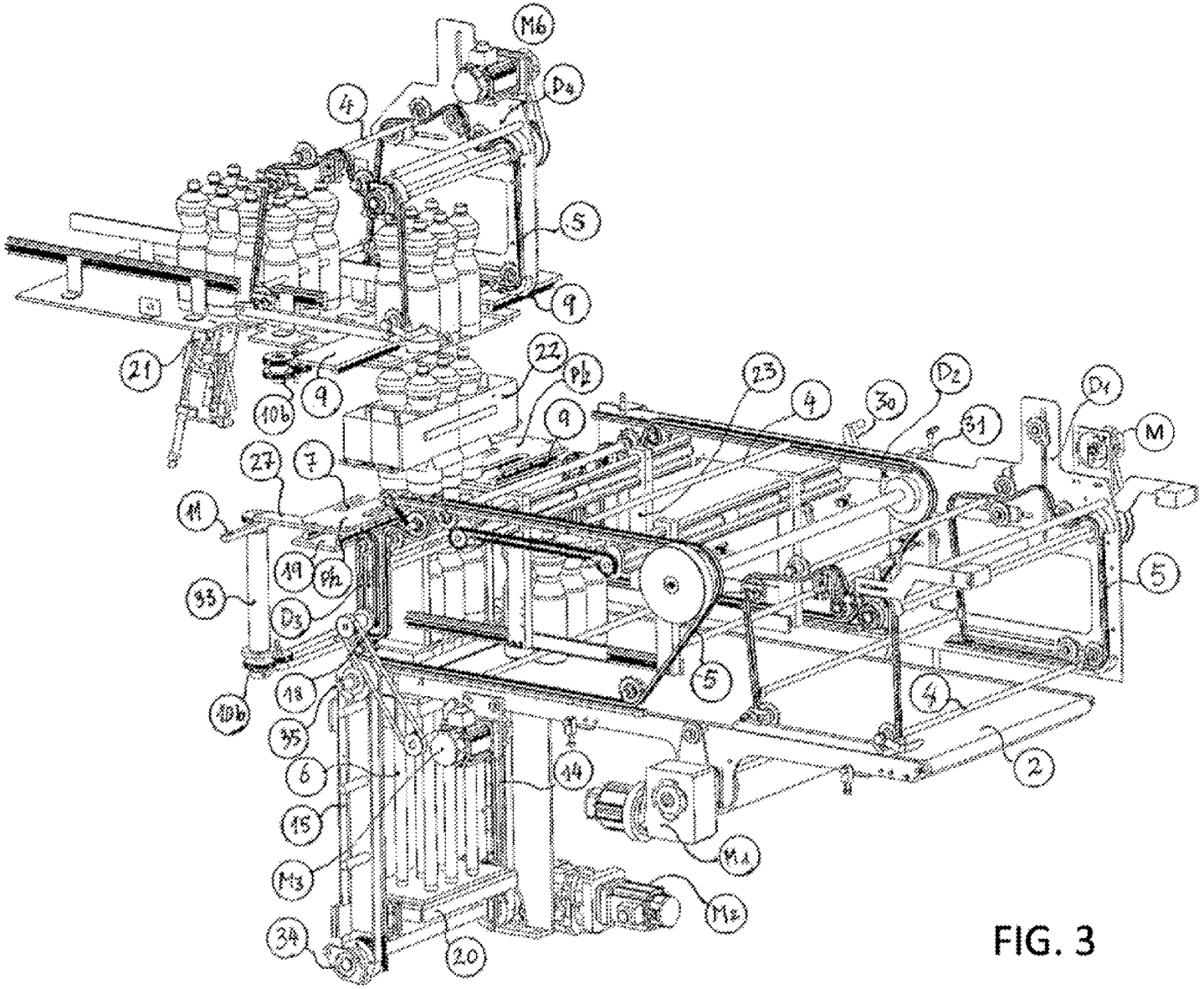
FIG. 3 is a plant axonometry (without strapping machines R1, R2 and R3).
Figure 4:
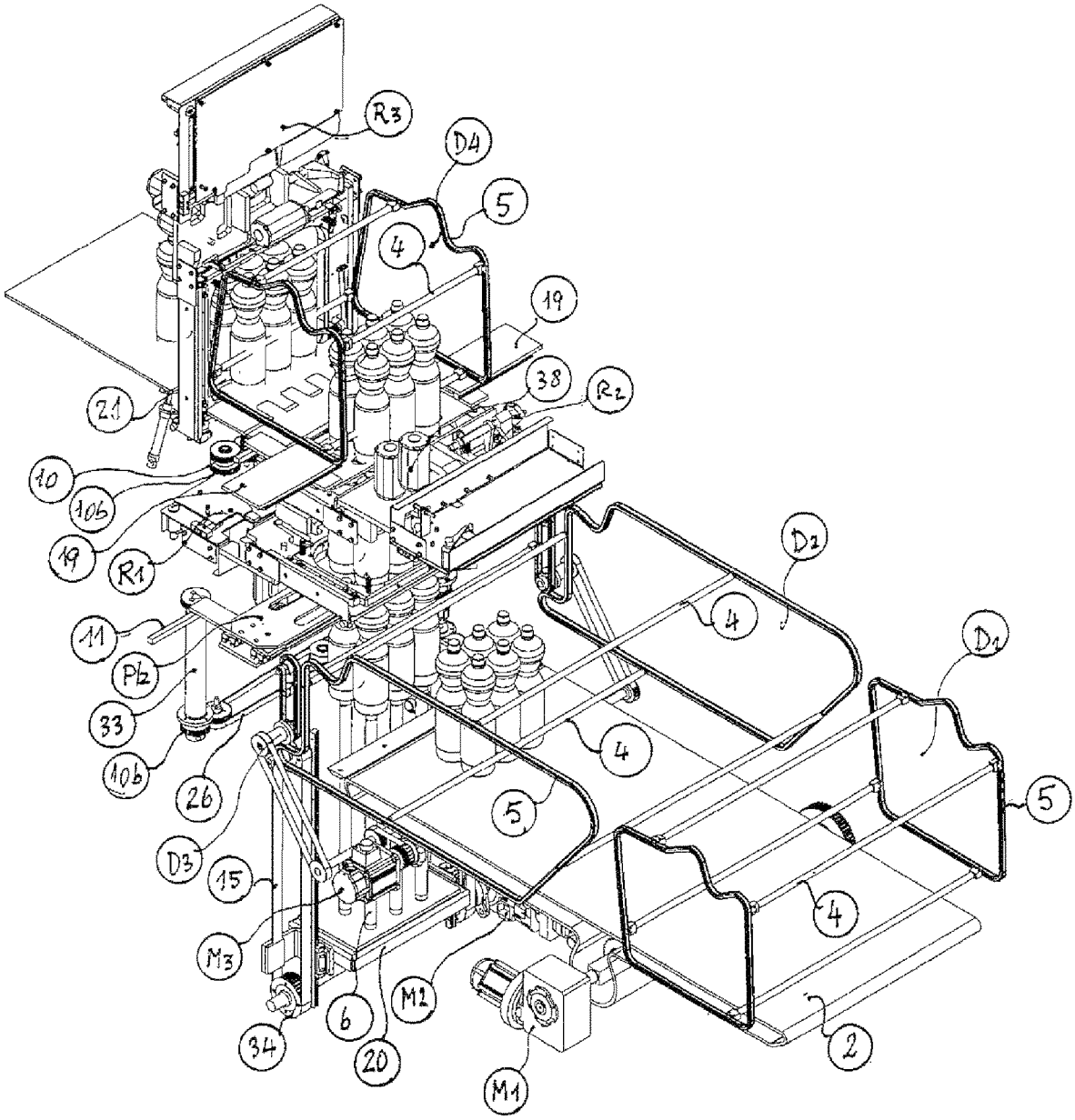
FIG. 4 is a plant axonometry (without details of D1, D2, D3, D4).
Figure 5:
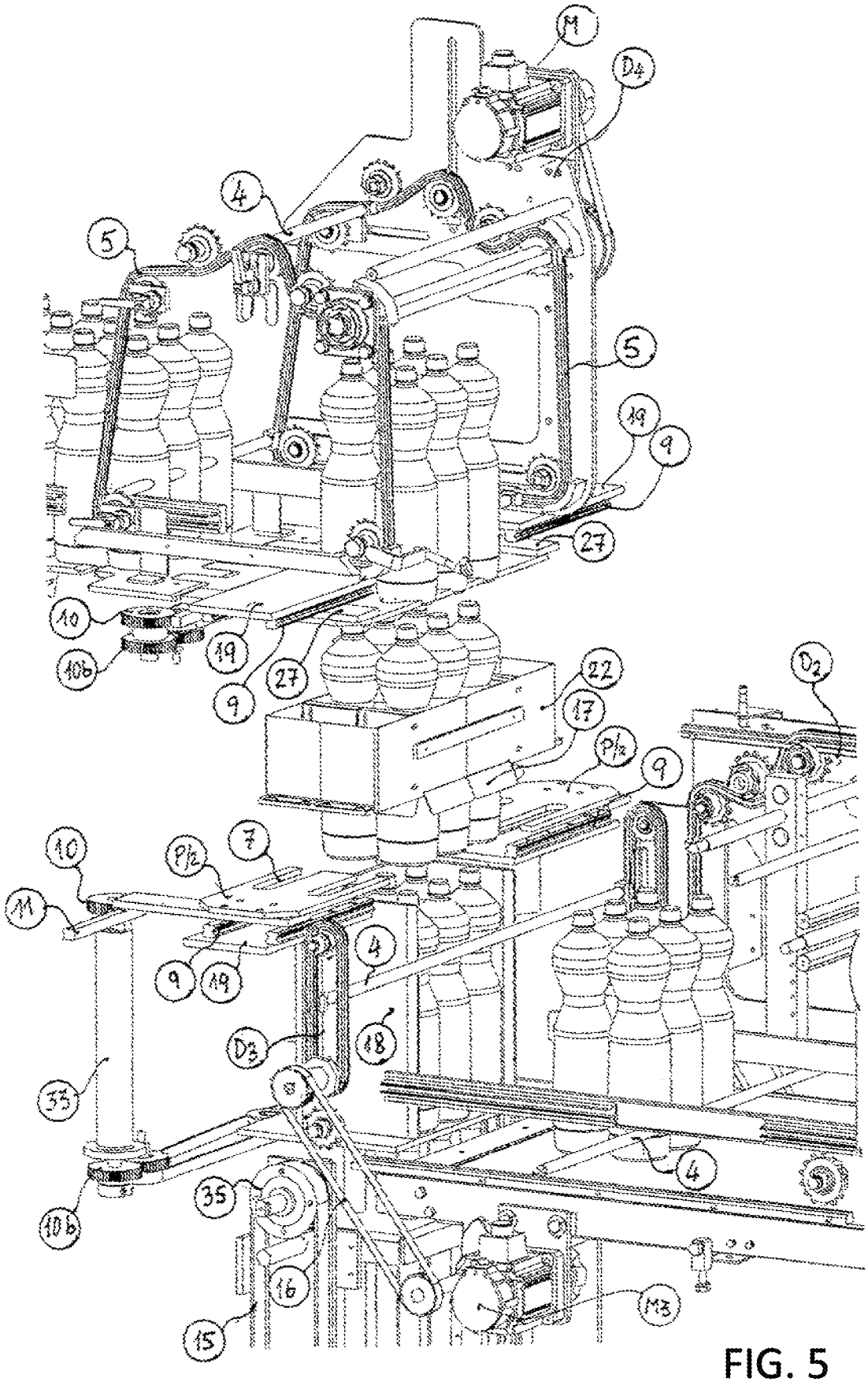
FIG. 5 is an axonometric detail of the tower with 3 levels (without strapping machines R1, R2 and R3).
Figure 6:
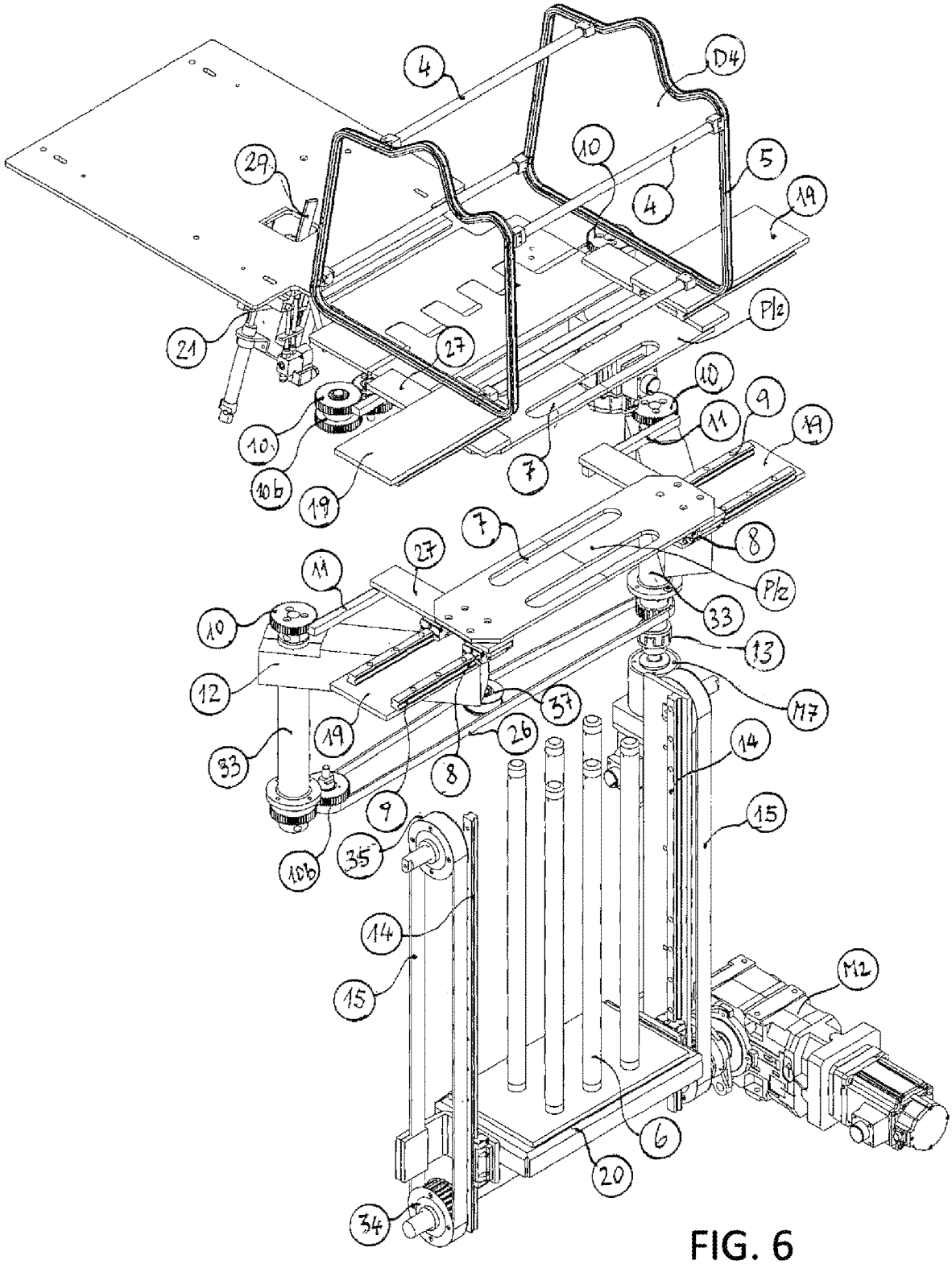
FIG. 6 is an exploded view of the details of the half-surfaces P/2 at levels L2 and L3.

In the present description and in the claims the term strapped means the fact of having applied a strap. The term to strap means the action of applying one or more straps. The term strap means a flexible band-like and not elastically extensible element that is tightened around a group of objects, the two ends of said band being connected with each other such to firmly remain joined in the tightened condition.

The plant of the present invention is about an operating unit able to perform a rapid packing, that is a safe, simple and transportable pack 1 obtained by means of three straps: one strap applied on the lower half of the body of the bottles 1, the second one applied at the neck of the bottles 1, both arranged on planes perpendicular to the vertical axes of the bottles 1, the third one, on the contrary, applied loose and perpendicular to the other two straps, lies on a vertical plane passing by the center of gravity of the pack, that is it is arranged on a plane comprised between two adjacent rows of bottles 1 in contact with each other for example in the plane that separates the two rows of three bottles 1 of the standard pack made of six bottles 1.

The bottles 1 conveyed from the conveyor NT after a sorting area 25 come to the area of the horizontal movement bars 4 of the two movement devices D1 and D2 that is pre-assembling devices where they are arranged, together with the pusher 23 in the predetermined configuration of the packs.

Such pre-assembling operation is performed by three devices D1, D2 and D3 acting in conjunction with the pusher 23 and in synchrony with the feeding of the feeding conveyor belt NT. These three devices are composed of chains 5, possibly running along annular rigid guides parallel with each other and arranged at the sides of the conveyor belt NT. Said devices are driven by monitored electric motors M3, M4, and M5. These chains 5 are orthogonally fastened to horizontal bars 4 moving parallel to the surface of the feeding conveyor belt NT, which are in contact with generatrices of the bottles 1 to be arranged.

The first device D1 acts for making the rows of bottles transversally parallel and for giving them to the second device D2 that, together with the pusher 23 moves them near each other and pushes them on the fixed perforated surface P1 of the first level L1 where said bottles 1 are kept laterally and at the back by a box-like structure 18 that is open and composed of two parallel surfaces that are fixed, vertical, rigid and integral with a surface perpendicular thereto. Said vertical surfaces have each one a leading portion with an inclined wall. These two vertical surfaces with the integral surface joining them of the open box-like structure 18 secure the bottles 1 in the desired pre-assembled position on the surface P1 of the first level. Said surface P1 is perforated such to leave the columnar rods 6 to pass therethrough, such that the vertical axes of the bottles 1 coincide with the centers of the holes made in the surface P1. The third device D3 is another vertical closed circuit where two chains 5 run, possibly along two parallel and vertical annular guides, to which horizontal bars 4 are fastened that, by vertically sliding along the bottles 1 already assembled on the surface P1 of the first level L1 guarantee them to be properly positioned on the holes of the surface P1 and follow them during the lifting movement.

The fixed surface P1 of the first level that is where the pre-assembled bottles 1 to be horizontally strapped are stopped, is, as mentioned above, perforated with a number of circular holes equal to the number of bottles 1 to be strapped and whose centers are arranged at the vertical, central axes of the assembled bottles 1.

By modifying the rigid structure 20 and the relevant columnar rods 6, as regards the number and relative arrangement of the columnar rods 6 with respect to each other, thus different types of bottles 1 or other similar containers and their number can be strapped with the same plant.

Under said surface P1 of the first level L1 there is provided the device for lifting the packs, that is the set of bottles intended to form the packs. Said device is composed of a flat rigid structure 20 on which cylindrical columnar rods 6 are perpendicularly fastened, whose length is slightly greater than the height of the bottles, while their programmed stroke is equal to the lifting of the bottles between first level L1 and second level L2. The flat rigid structure 20 to which the columnar rods 6 are fastened can slide along two vertical guides 14 like an elevator, and it is driven by two endless, closed toothed belts 15 to which the structure 20 is connected by means of side slides slidably engaged along the guides 14 and connected by brackets to the respective belt 15. Each one of such belts 15 is driven by a lower gear wheel 34, the two gear wheels being both driven by a shared monitored electric motor M4 and said belts being kept as stretched at the top by other two idle gear wheels 35.

Summarizing, the bottles 1 placed and arranged on the perforated fixed surface P1 of the first level L1 are lifted from the first level L1 to the second level L2 by the cylindrical columnar rods 6 that pass through the holes of said fixed and perforated surface P1. When the plant is in the full operating condition the pre-arranged bottles 1 not strapped yet at the first level L1, upon being lifted, push the strapped bottles 1 above from the second level L2 to the third level L3, by means of the half-surfaces P/2 arranged on the second level L2 and third level L3 that open in a synchronized manner. The weight to be lifted therefore corresponds to the weight of two packs. At the second level L2 the bottles 1, resting on the two half-surfaces P/2 that are closed, that is moved near each other, are strapped by two horizontal straps 24 applied by two conventional strapping machines R1 and R2 whose arches are horizontally arranged.

A strap 24 is applied at the lower half of the body of the bottles 1 while the second strap 24 is applied at the neck of the bottles 1 just under the extruded collar provided below the cap. During such strapping operations the bottles 1 are kept still, with a minimum clearance, by means of a box-like structure 22 open at the top and at the bottom and arranged at a fixed level between said two horizontal straps 24.

The half-surfaces P/2, at the second L2 and third level L3 are movable with respect to each other and with respect to the central surface of the bottle group such to be openable and closable, that is movable near to and away from each other with a horizontal translation and parallel thereto in the direction transversal to the feeding direction of the bottles and/or the lifting direction thereof.

Said surfaces are intended to strap the conventional pack of six bottles 1 and are composed of rigid plates each one having two slits 7 slightly wider than the cap of the bottles and slightly longer than the diameter of one bottle 1, while the distance between two slits 7 is exactly equal to the diameter of the bottles 1. All said half-surfaces P/2 that is those of the second level L2 and of the third level L3 slide by means of two slides 8. Each one of said slides contains rolling balls constrained thereto along two hollow tracks 9, integral with two fixed surfaces 19. The synchronized and timed opening and closing movement of said half-surfaces P/2, mounted on the slides 8, of the second level L2 and third level L3, is guaranteed by a motor M7 and M8 for each level L2 and L3. The main spindle 33 that, by means of a gear wheel 10, drives an associated rack 11 meshing therewith, of one of the two half-surfaces P/2 of the level L2 is driven by its motor M6. To such spindle 33 a second gear wheel 10*b* is fastened which transmits the rotation to a second parallel spindle 33 equipped also with an identical gear wheel 10*b* by means of a toothed belt 26 equipped with a tightener 37. To this second spindle 33 another gear wheel 10 is also fastened that in turn drives the second rack 11, with which it is meshed, of the second half-surface P/2. Both the racks 11 are fastened to their relevant half-surfaces P/2 by side arms 27. The two half-surfaces thus can be moved in the two directions, that is moving away from each other for being opened and moving near each other for being closed. The other two half-surfaces P/2 of the third level L3 are also driven by a single motor M7 by the same components and the same mechanical modes of the second level L2.

Once the bottles 1 on the surface P2 of the level L2 are horizontally strapped, the bottles 1 of the pack below to be strapped are just lifted by the columnar rods 6 till supporting at the bottom the already strapped bottles 1, which then will rest on the caps of the bottles 1 below not strapped yet.

During such last time period, the bottles 1 strapped and rested on the half-surfaces P/2 of the third level L3 are pushed under the vertical strapping machine R3 by one of the horizontal bars 4 of the movement device D4 of the third level L3. The two half-surfaces P/2 of the second L2 and third level L3 then will open and the cylindrical columnar rods 6 will lift contemporaneously the bottle pack, that is the group of bottles corresponding to the pack still to be strapped, from the first L1 to the second level L2 and the pack of horizontally strapped bottles 1 from the second L2 to the third level L3.

Now the half-surfaces P/2 of the second level L2 and of the third level L3 will close and the columnar rods 6 will return back to their original position while the bottles 1 still to be strapped blocked by the open box-like structure 22 will rest on the closed half-surfaces P/2 of the second level L2 and the horizontally strapped bottles 1 will rest on the closed half-surfaces P/2 of the third level L3.

Just after applying the loose strap 24 by the strapping machine R3, the strapping process is completed by applying glue by means of a device 21 that penetrates a probe 29 applying the glue between the two bottles 1 exactly at the center of the pack. Said device is claimed and described in the patent application n. CH1555/14 (publication n. CH710938).

The plant of the present invention can be also used advantageously for strapping containers similar and/or equivalent to PET bottles (1) by replacing the half-surfaces P/2 of the second level L2 and third level 13 with grippers 32 with elastic jaws.

The operation is substantially the same, except for the use of said grippers 32, whose jaws are shaped such to move the sections of the several containers 28 and 36.

A variant embodiment of the invention provides a plant according to what described above, wherein the tower lifting the groups of bottles from the lower level L1 to the upper level L3 is replaced, at least partially, by an arm or transfer device of the type known under the name pick and play.

Such solution avoids providing the supporting half-surfaces P/2 of level L2 of the first strapping station, and of the upper level L3 for the transfer to the second strapping station.

A first variant provides the pick and play transfer device to pick the containers with a gripper in the first strapping station and to hold them in place in such station, than transferring them to the second strapping station, that is to the station applying the loose strap intended to form the carrying handle.

A further variant provides the pick and play transfer device to directly pick the groups of containers at the exit of the conveyor grouping/assembling the groups of containers denoted by D2 when they are on the surface P1.

In this case the pick and play transfer device makes a path in two steps, a first step for placing and holding the bottle group in the first strapping station at level L2 and, after applying the straps, a second step for transferring the bottle group from the first to the second strapping station.

As the pick and play transfer device it is possible to use any device of the robotic arm type or similar devices that is provided associated to the plant and configured and designed for carrying out the transfer and holding steps described above.

Figure 7:
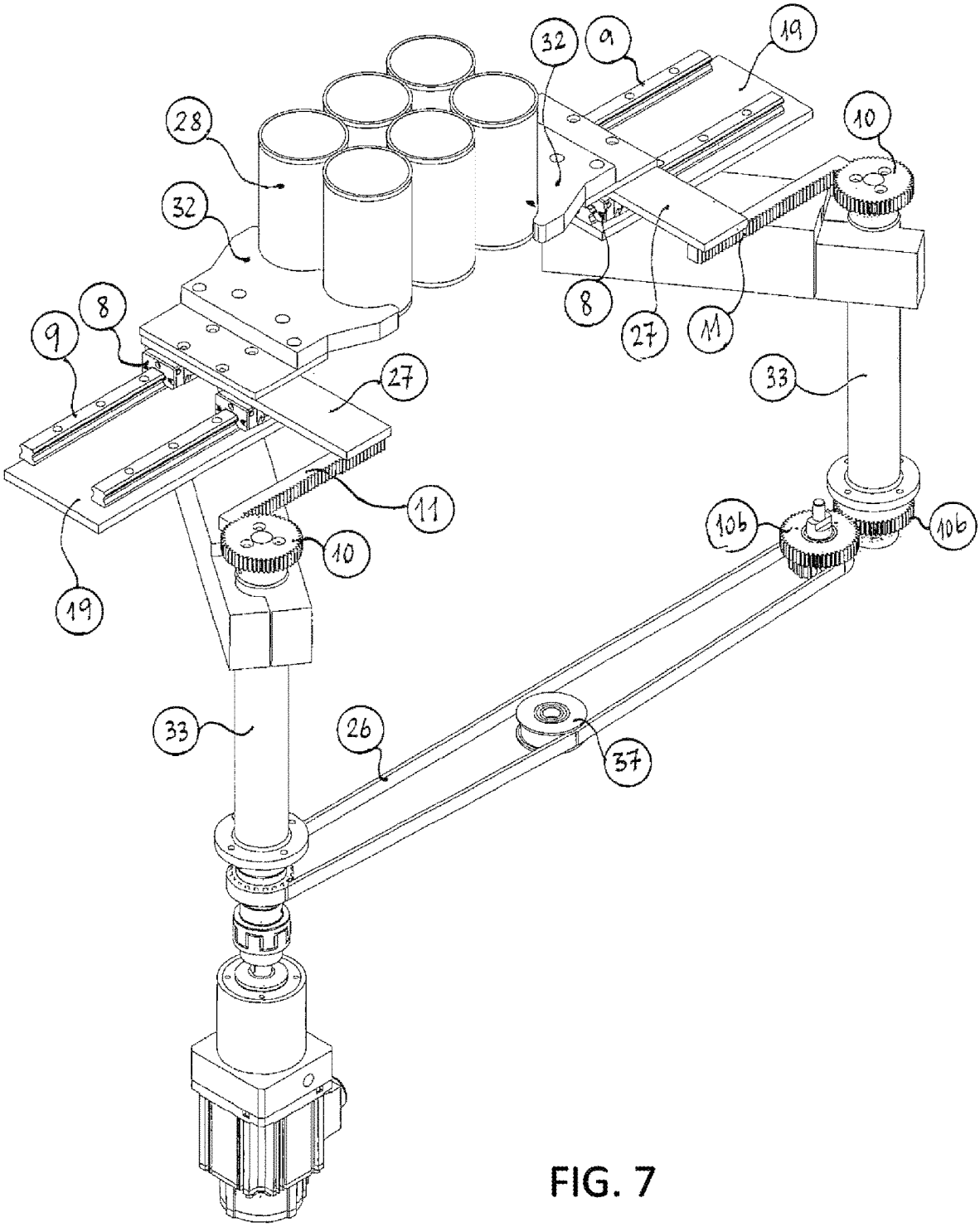
FIG. 7 is a detail of the vertical movement with grippers 32 for cans.
Figure 8:
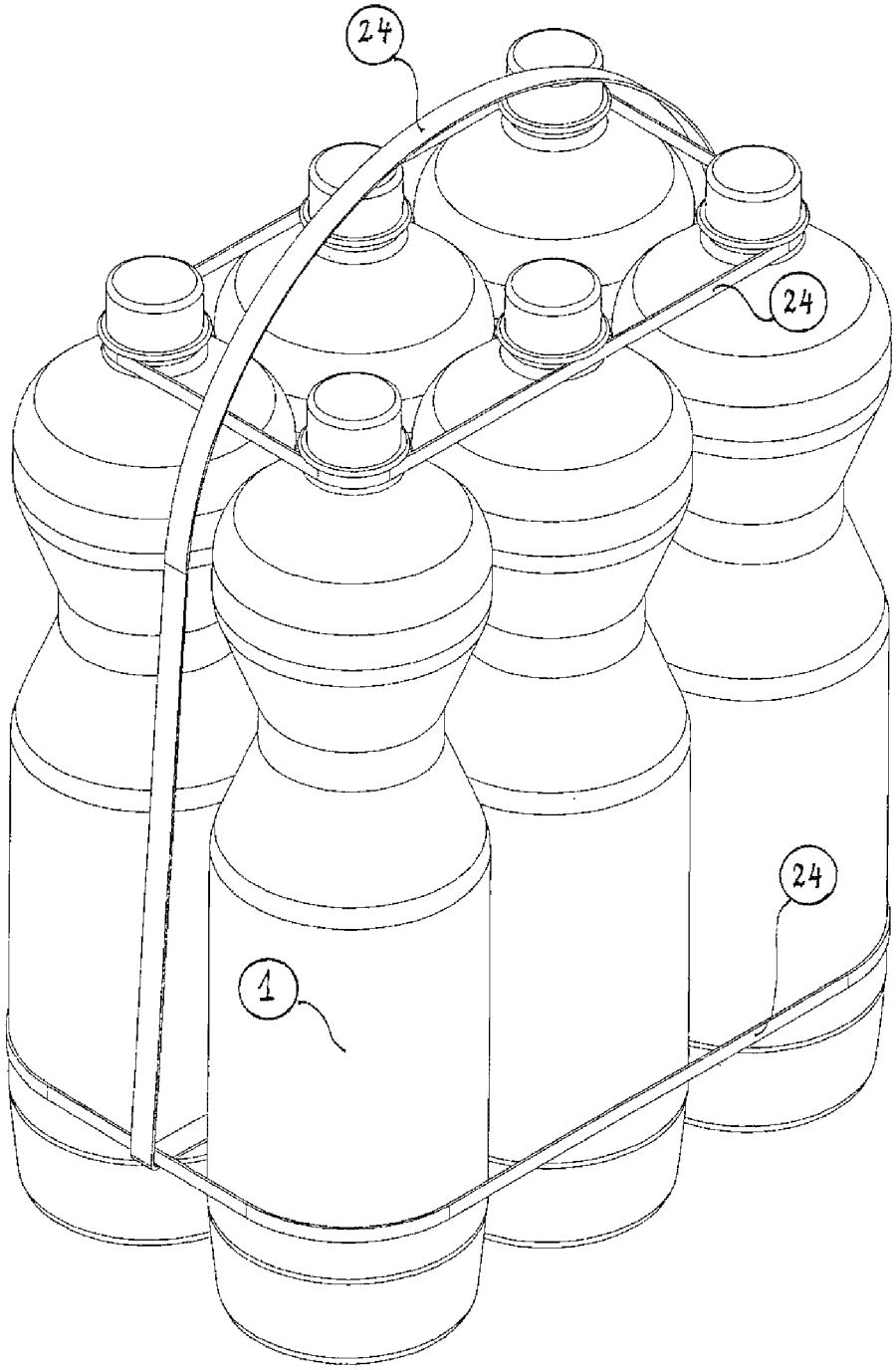
FIG. 8 is a strapped pack of bottles 1.
Figure 9:
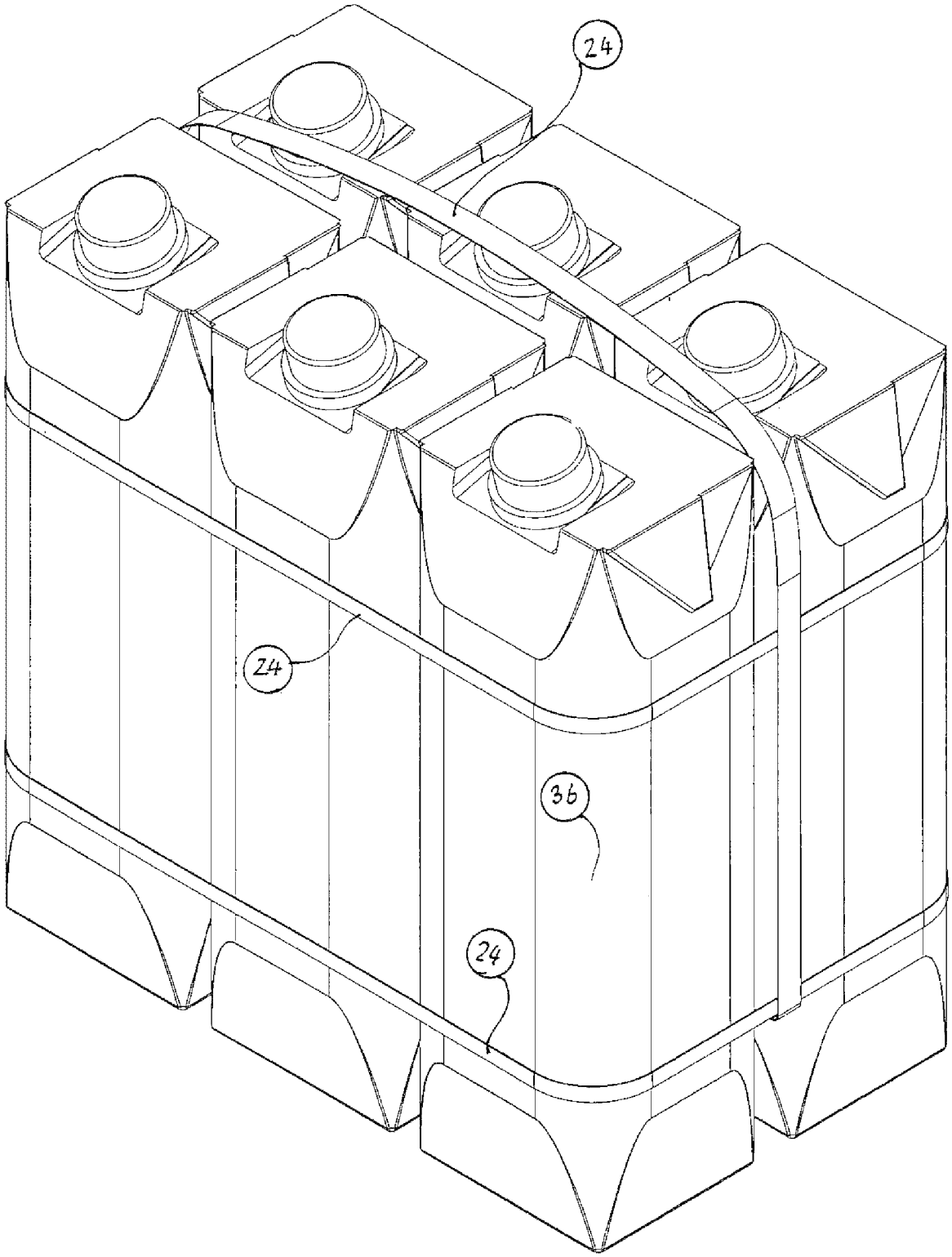
FIG. 9 is a strapped pack of quadrangular-shaped section containers.
Figure 10:
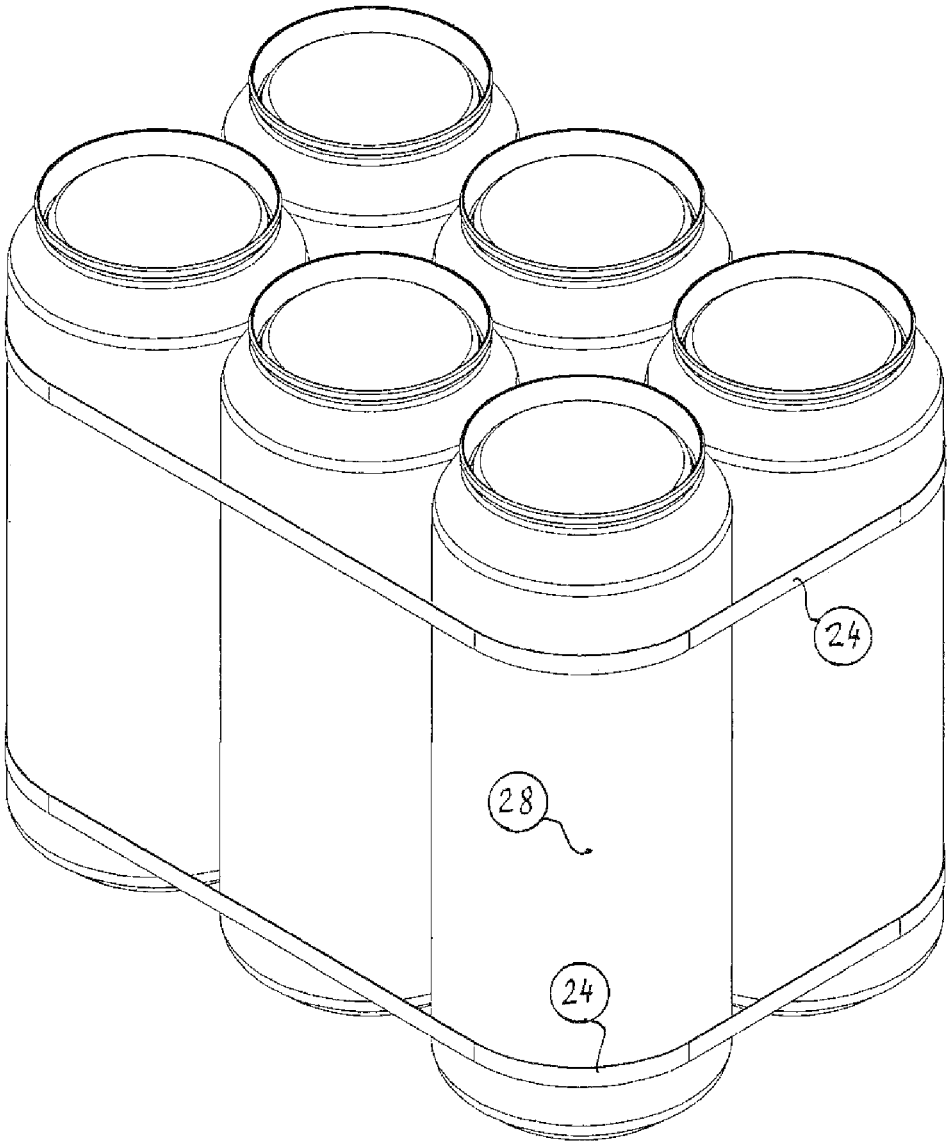
FIG. 10 is a strapped pack of cannikins or cans made of aluminium.

Grasping grippers can be provided with at least two jaws each one cooperating with one of two opposite sides of the container group having a contact surface shaped in a manner corresponding to the area in contact with the peripheral containers of the container group. Grippers of such type can be made for example such as shown and described with reference to FIG. 7. Other types of grasping devices are possible and their configuration depends on the outer shape of the containers.

Figure 11:
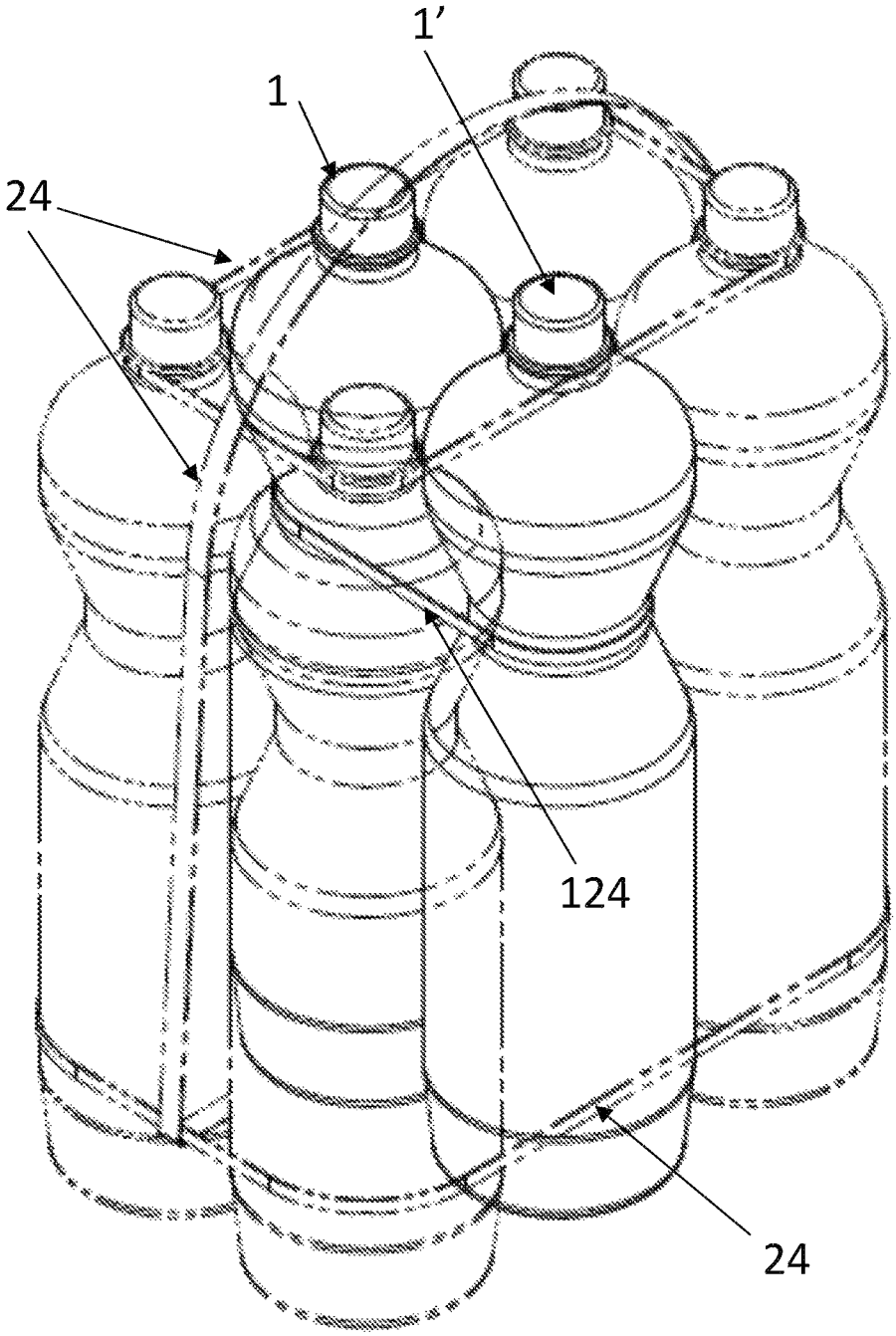
FIG. 11 is an example of a pack where two containers in the central position are tightened together by a band-like element that restrains or prevents them from accomplishing a relative counter-rotation such to exert an action that in turn prevents the containers of the group from taking a quincunx position.

FIG. 11 shows a pack provided with a quincunx-preventing system, that is a pack where the containers are efficaciously prevented from taking a relative quincunx position. Such effect occurs above all for groups of containers having six or more containers and wherein the containers are placed on several rows and/or lines, the distance between two adjacent containers corresponding to a maximum diameter of said containers with reference to the central axis thereof.

As an alternative to the application of glue between two containers of the central row of the group of six containers denoted by 1', the present embodiment in order to considerably restrain or prevent said containers from accomplishing a counter-rotation with respect to each other, provides said two containers 1, 1' to be further bound together by a predetermined tightening force by a strap 124. The tightening force is calculated such to generate friction between the contact areas of the containers 1, 1' that considerably restrains or prevents them from counter-rotating. Such arrangement is functional to prevent the containers from passing from the aligned position to the quincunx position.

With reference to the plant, such further strap connecting the two central containers occurs in a pre-strapping station provided upstream the grouping/assembling conveyor denoted by 25, D1 and D2 in the figures.

The pre-strapping station, not shown in details, can provide a pusher for two bottles in the feeding flow which are intended to take a central or intermediate position in the container group of the type similar to that operating for grouping and assembling the whole container group and a unit applying one or more straps like the one provided in the first strapping station.

According to a further variant, when the container groups provide a higher number of rows, lines and therefore a number of containers higher than six containers, it is possible to join together two or more containers that are at least in an intermediate position, or even central position, with respect to the arrangement of the remaining containers of the group.

REFERENCES

1), 1') Bottles (or other similar containers)
2) Conveyor belt
3) Skid
4) translation bars
5) chains of movement devices D1, D2, D3 and D4
6) Vertical columnar rods
7) Slits in the half-surfaces P/2
8) Slides of half-surfaces
9) Tracks for the slides of the half-surfaces 8
10) Gear wheels for opening the half-surfaces
11) Racks meshed in the gear wheels 10
12) Support of surfaces 19
13) Joint of motor M7
14) Guides of structures 20 with rods 6
15) Toothed belts of the device D5
16) Toothed belts of the device D3
17) leading portions of the box-like structure 22 at level L2
18) Box-like structure at level L1
19) Support surfaces for the tracks 9
20) Base plate of the columnar rods 6
21) gluing device
22) Box-like structure with leading portions at level L2
23) Pusher
24) Straps
25) sorting area
P1) fixed perforated surface (level L1)
P2, P3) Surfaces of levels L2 and L3
124) quincunx-preventing strap

The invention claimed is:

1. A plant for applying straps to a group of containers such as bottles or the like, said group comprises a predetermined number of containers arranged according to a predetermined order and a predetermined relative position with respect to each other, said plant comprising, in sequence along a feeding path of the containers or groups thereof:

a grouping or assembling conveyor for the group of containers arranged in upright position or resting on a conveying surface, said containers having a rest side on the conveying surface, the grouping conveyor generating the groups of containers having a predetermined number of the containers in the predetermined relative position, a feeding direction along said grouping conveyor being substantially in a horizontal plane;

a lifting conveyor lifting the groups, in sequence with each other, along a vertical lift path for feeding and unloading one of each group of containers to a first strapping station adapted to apply one or more straps, spaced from each other in an axial direction of the containers, perpendicularly to the rest side thereof, to the container group; and a horizontal transfer device for the groups of containers provided with one or more straps applied in the first strapping station, so as to transfer each group to a second strapping station;

wherein said second strapping station is configured to apply a loose strap developed in a plane essentially vertical and/or perpendicular to the rest side of the containers and/or parallel to the axis of the containers, and wherein the loose strap surrounds the one or more straps applied in the first strapping station.

2. The plant according to claim 1, wherein the lifting conveyor is configured to move each group of containers of the sequence from an initial container infeed level in the lifting conveyor, to an intermediate lift level where there is provided the first strapping station, and from this second level to a third upper level unloading the group of containers provided with the one or more straps applied in the first strapping station with lift steps corresponding to a relative distance between two subsequent levels.

3. The plant according to claim 2, wherein the distance between said two subsequent levels corresponds to a size of the containers in the lifting direction, the containers of a lower level being pushed upwardly by lifting pusher members and the containers of the second level being moved to the subsequent third level by the containers of a level below that rest by their upper sides on lower sides of the containers of the group at a level above.

4. The plant according to claim 3, wherein the containers of the groups of containers at the upper levels are held in lifted position by a holding support that is operable alternatively in an operating position interfering with the group of containers, causing interference that allows the containers at the upper levels to be held and to remain in an idle position, so that a lift path from a level below to the upper level is cleared.

5. The plant according to claim 4, wherein there are a plurality of holding supports composed of support surfaces provided at said upper levels and are formed of several parts completing with each other and movable together in a direction near to each other and arranged under the rest sides of the containers of a corresponding group and alternatively in a direction moving away from each other and moving away from the containers of the corresponding group.

6. The plant according to claim 5, wherein the several parts of the support surfaces are shaped as forks.

7. The plant according to claim 4, wherein there is a plurality of holding supports composed of grippers provided with at least two opposite jaws shaped in a manner corresponding to a profile or shape of the containers on sides of the group facing said jaws.

8. The plant according to claim 1, wherein the lifting conveyor is replaced by a transfer device of a pick and place type, which holds in place said containers during strapping in the first strapping station and transfers said containers to the second strapping station.

9. The plant according to claim 8, wherein the transfer device is made or configured to pick by a grasping gripper the groups of containers at the lower level, when exiting from the grouping or assembling conveyor.

10. The plant according to claim 1, wherein, in combination with the container groups comprising containers arranged on several rows and lines, each group has several rows of four containers, and wherein, downstream of the first strapping station, the plant comprises a station applying glue between at least two containers of the group provided in an intermediate position of the containers of said groups, thereby preventing or restraining the at least two containers from accomplishing a mutual counter-rotation movement and preventing the containers of the strapped group from taking a quincunx position.

11. The plant according to claim 1, wherein, in the feeding path of the containers of the grouping or assembling conveyor for the groups or upstream thereof, there is provided a grouping or strapping station for at least two containers that are intended to be disposed in a central or intermediate position inside an arrangement of the containers of a group of containers corresponding to a position taken in the group of containers provided with the one or more straps.

12. The plant according to claim 11, wherein a mutual tightening of the at least two containers in central and intermediate position is provides a tightening force causing a friction between contact areas of said at least two containers to be increased to such an extent to at least restrain a mutual counter-rotation movement of the at least two containers and prevent the containers of the group from taking a quincunx position.

13. A plant for assembling PET bottles (1) into packs comprising a plurality of bottles (1) with straps (24) comprising:

a conveyor belt (2) adapted to feed the bottles (1) and moved by a motor (M1);

three movement devices (D1, D2, D3) adapted to assemble and prearrange a flow of said bottles along said conveyor belt (2) such to form bottle groups with a number of the bottles and with a relative position of the bottles of the group identical to a position in a final pack; and a tower composed of a vertical structure with three levels (L1, L2, L3) provided vertically aligned and at different heights and comprising a first lower level (L1) having a first surface (P1), which is fixed and perforated, at the first level (L1) adapted to receive rods engaging movable half-surfaces (P/2) of a second level (L2) and a third level (L3), on the first surface (P1) the bottles (1) being arranged in an orderly way, set and pushed by horizontal bars (4) moved by two chains (5) of movement devices (D1, D2, and D3), and resting on said surface (P1) of the lower level (L1) for being then lifted to the second level (L2) by the rods (6) disposed vertically and movable parallel thereto and passing through holes of said first surface (P1), at a second level (L2) there being provided a stop for applying, on the bottle group, contemporaneously two horizontal straps (24), with two strapping machines (R1, R2), with horizontal arch, and then, once strapped, said bottle group being lifted to a third level (L3) directly pushed by the bottles of a subsequent group of bottles (1) below that are prearranged but not strapped yet and pushed in turn upwards by said rods (6), and finally, by a movement device (D4) moved by a second motor (M6), said bottles (1) provided with two horizontal straps (24) which are placed under a third strapping machine (R3) with a vertical arch for applying a third loose strap (24) arranged on a plane orthogonal to the two horizontal straps (24) and going around the two horizontal straps in order to create a lace acting as a handle for carrying by hand the final pack.

14. The plant according to claim 13, wherein the bottles (1) are assembled on the conveyor belt (2) by the three movement devices (D1, D2, D3) in conjunction with a pusher (23) in a predetermined configuration and moved till being stopped on the first surface (P1), by three fixed surfaces (18) that are rigid, vertical, orthogonal and integral with each other and forming a compartment open at a top and at a bottom and on a side wall facing a feeding direction, waiting for being lifted to the second level (L2) where the bottles are horizontally strapped.

15. The plant according to claim 13, further comprising a tower or vertical structure along which the bottles (1) are lifted, the tower having three levels (L1, L2, L3) shaped as three surfaces provided at three different heights, of which a first height (P1) is the first surface (P1) equipped with a series of holes for passage of the rods (6) pushing from the bottom, which act for lifting the bottles (1) that have been prearranged from the first lower level (L1) to the second level (L2) and then strapped and pushed by the bottles (1) below, not strapped yet, from the second level (L2) to the third level (L3), wherein second (P2) and third (P3) surfaces are composed of two movable half-surfaces (P/2) alternatively moving near to and away from each other according to a lateral direction perpendicular to the feeding direction of the bottles in order to leave the bottles (1) passing from one level to a subsequent level.

16. The plant according to claim 15, wherein on the first level (L1), in proximity of the first surface (P1), a further device (D3) having a monitored motor (M3) is installed and driving two chains (5), horizontal bars (4) being orthogonally fastened to the two chains and acting, by being moved upwardly, for keeping the bottles (1) aligned in a predetermined configuration during a lifting operation of the bottles (1) from the first level (L1) to the second level (L2).

17. The plant according to claim 16, wherein the half-surfaces (P/2) of the second (L2) and third level (L3) each have two parallel and longitudinal slits (7) each wider than a diameter of necks of the bottles (1) and having a length equal to a distance between two necks of the bottles (1) when assembled, said half-surfaces (P/2) being moved away from each other to leave packs of the bottles (1) to pass lifting to the second (L2) and the third level (L3) and being further moved near each other to support said packs during a double strapping operation at the second level (L2) and for a time necessary to move the packs under the third strapping machine (R3) placed at the third level (L3).

18. The plant according to claim 15, further comprising a lifting device (D5) lifting the bottles (1) arranged under a base of the tower or vertical structure, said tower or vertical structure being composed of a series of cylindrical columnar rods (6) fastened to a base plate (20) guided by two vertical tracks (14) as an elevator, the base plate (20) being vertically driven by two toothed belts (15) arranged on two sides of the base plate (20) and driven by a monitored motor (M2).

19. The plant according to claim 15, wherein the two half-surfaces P/2 placed at the second level (L2) and the two half-surfaces placed at the third level (L3) contemporaneously open when the packs to be strapped have to be lifted from the first level (L1) to the second level (L2) and the packs that have been strapped have to be lifted from the second level (L2) to the third level (L3) and contemporaneously close in order to support at the second level (L2) the packs during a strapping operation and to support the packs after strapping at the third level (L3) before being pushed under a third strapping machine (R3) by a bar (4) of the movement device (D4) where a loose strap (24) is applied, acting as a handle (31).

20. The plant according to claim 15, wherein the half-surfaces P/2 of the second level (L2) and of the third level (L3) are each equipped with a slide (8) containing balls disposed to run along two tracks (9) which are integral with two fixed surfaces (19) integral with a structure of the tower, wherein a rack (11) for each half-surface (P/2), integral with an arm (27) connected to each half-surface (P/2), is driven by a gear wheel (10) meshed therewith, and wherein two parallel spindles (33) of said gear wheels (10) are made to rotate together by a toothed belt (26) provided with a tightener (37), the toothed belt (26) being interlocked with two other gear wheels (10*b*) mounted on the two spindles (33), which are driven by one of two synchronized electric motors (M7 or M8), thus allowing the half-surfaces (P/2) of the second (L2) and the third (L3) levels to contemporaneously open and close.

21. The plant according to claim 15, wherein the bottles (1) to be strapped at the second level (L2) are kept assembled in a configuration to be strapped at said second level by a box-shaped structure (22) open at a top and at a bottom and placed permanently between two upper and lower levels strapping the bottles (1).

22. The plant according to claim 21, wherein the first and the second strapping machines (R1 and R2) provided at the second level (L2) and each driven contemporaneously by monitored electric motors (38) have horizontal encircling arches arranged such that the second strapping machine (R2) straps a body of the bottles (1) in a section comprised in a lower half of the bottles (1) under the box-shaped structure (22), and wherein the third strapping machine (R3) straps the bottles (1) above the box-shaped structure (22) at their neck under an extruded collar placed below an opening configured to couple with a cap.

23. The plant according to claim 20, further comprising on the third level (L3) of the tower, besides the two movable half-surfaces (P/2) by the synchronized electric motor (M7), a fourth movement device (D4) controlled by an additional motor (M5) that drives the two chains (5), horizontal bars (4) being fastened thereto which push the pack horizontally after strapping under the third strapping machine (R3) with vertical arch that applies the third loose strap acting as a handle (31).

24. The plant according to claim 15, wherein at the third level (L3) on a coplanar surface where a conveying belt (2) runs for discharging the bottles (1) there is provided the third strapping machine (R3) having a vertical arch configured to apply the loose strap (24) acting as a handle (31).

25. The plant according to claim 24, wherein after the third strapping machine (R3) there is provided a device (21) adapted to inject glue between two bottles (1) at a center of the pack by using a probe (29) equipped with a channel ending in two micro holes for a dosed discharge of the glue.

26. The plant according to claim 13, wherein the plant is adapted to strap containers having quadrangular-shaped sections or shaped as beverage aluminum cans (28).

27. The plant according to the claim 26, wherein the half-surfaces (P/2) of the second (L2) and third level (L3) are replaced by grippers (32) driven by synchronized motors, jaws of such grippers being made of elastic materials and being shaped to meet sections of the containers to be strapped.

* * * * *